United States Patent [19]

Halberschmidt et al.

[11] Patent Number: 4,528,780

[45] Date of Patent: Jul. 16, 1985

[54] PROCESS AND APPARATUS FOR THE CONTROL OF POSITION OF A TOOL OF AN EDGE-PROCESSING MACHINE FOR GLASS PANES

[75] Inventors: Friedrich Halberschmidt, Herzogenrath; Heinz-Josef Reinmold; Josef Audi, both of Aachen, all of Fed. Rep. of Germany

[73] Assignee: Saint-Gobain Vitrage, France

[21] Appl. No.: 459,115

[22] Filed: Jan. 19, 1983

[30] Foreign Application Priority Data

Jan. 20, 1982 [DE] Fed. Rep. of Germany ..... 3201495

[51] Int. Cl.[3] ..... B24B 9/10

[52] U.S. Cl. ..... 51/165.8; 51/97 NC; 51/101 R; 51/105 EC; 51/283 E; 144/137; 144/144 R; 144/356; 409/80; 409/92; 409/186

[58] Field of Search ..... 51/99, 100 R, 101 R, 51/101 LG, 103 C, 105 EC, 105 LG, 106 LG, 165.71, 165.74, 165.8, 165.89, 283 R, 283 E, 165.77, 165.91, 165.92, 91, 92, DIG. 33, 97 NC; 83/74; 409/80, 97, 104, 110, 111, 112, 166, 186; 144/144 R, 137, 356

[56] References Cited

U.S. PATENT DOCUMENTS

| | | | |
|---|---|---|---|
| 2,579,337 | 12/1951 | Reaser et al. | 51/283 E X |
| 2,995,876 | 8/1961 | Frick | 51/101 R |
| 3,062,996 | 11/1962 | Ertell et al. | 51/100 R X |
| 3,100,954 | 8/1963 | Lella | 51/165.77 |
| 3,525,181 | 8/1970 | Carson | 51/101 R |
| 3,553,903 | 1/1971 | Christie | 51/165.9 |
| 4,064,659 | 12/1977 | Ulivi | 51/101 R X |
| 4,071,979 | 2/1978 | Ugo | 51/DIG. 33 |
| 4,299,061 | 11/1981 | Parnum et al. | 51/101 R |

FOREIGN PATENT DOCUMENTS

| | | | |
|---|---|---|---|
| 1928162 | 2/1969 | Fed. Rep. of Germany . | |
| 1387113 | 3/1975 | United Kingdom | 51/101 R |

*Primary Examiner*—Robert P. Olszewski

*Attorney, Agent, or Firm*—Pennie & Edmonds

[57] ABSTRACT

A process and apparatus for the control of the path of the grinding tool of an all-around edge grinding machine supporting a glass pane for movement about a rotational axis. The grinding tool is positively guided into contact with the edge of the glass pane as controlled by the contour of the glass pane. A scanning roller, also guided into contact with the edge of the glass panel provides the control heretofore described. Both the grinding head and scanning roller are movable in a direction toward the rotational axis of the glass pane. Path signals determined by the scanning roller are stored in a sliding register, and delayed at its output for a period of time required for movement of the glass pane through an angle which corresponds to the rotational angle ($\alpha,\beta$) between the point of contact of the scanning roller and the point of contact of the grinding tool on the edge of the glass pane. The path signals from the sliding register are used in position controlling the grinding tool. The scanning roller and the grinding tool each may be disposed on a sled for movement in directions colinear with a radius from the axis of rotation of the glass pane. The scanning roller and the grinding tool each may be disposed at the end of a rocker arm for movement along a circular path.

22 Claims, 4 Drawing Figures

90
91
98
R1
R2
R3
R4
R5
R6
R7
P1
P2
Z1
Z2
Z3
Z4
Z5
Z6
Z7
Z8
Z9
Z10
d1
d2
d3
±0V
50
47
7
6
45
48
49
51
95
96
13
23

PROCESS AND APPARATUS FOR THE CONTROL OF POSITION OF A TOOL OF AN EDGE-PROCESSING MACHINE FOR GLASS PANES

DESCRIPTION

1. Technical Field

The invention relates to a process for the control of a position taken by a grinding tool in processing (grinding) the edges of a glass pane and pressure exerted by the grinding tool during the process. The control and movement of the grinding tool are functions of the contour of the glass pane undergoing the process. The invention, also, relates to the apparatus for carrying out the process.

2. Background of the Invention

German Offenlegungsschrift No. 1928 162 discloses an edge grinding machine of the type of the invention. According to the publication, positive guidance of a grinding unit is provided by a template whose size and shape correspond to the size and shape of the glass pane to be edge ground. The publication, further, discloses that the template is placed parallel to the glass pane, and a guide roller which controls the edge grinding machine follows along the contour of the template.

Quite obviously the apparatus of the publication may be used in the positive guidance of the grinding unit when glass panes of the same shape and size are moved seriatim to the edge grinding machine to be processed. If, however, there should be a change in either the shape of the glass pane or the size of the glass pane, or both, from one glass pane to the next, either the template must be exchanged for a proper template or the program which shall determine the path of the grinding unit must be exchanged for another program. Furthermore, in the case of the known apparatus, such as that of the publication, a prerequisite of proper operation in grinding is that of precise positioning of the glass pane relative to the template or to a reference mark of the apparatus as determined by the control. These measures represent a considerable disadvantage of the prior art and a limitation of the apparatus.

SUMMARY OF THE INVENTION

The invention is directed to a process for the control of the position and path of a grinding tool of an all-around edge processing apparatus for glass panes. Particularly, the process is one which may be carried out without the requirement heretofore of a template. According to the process, the apparatus may be used in edge processing of glass panes of the most varied shapes without any special measures being necessary insofar as a requirement of change of the program of the path, or a precise positioning of the glass pane relative to some reference mark of the apparatus in the processing station.

The process may be characterized by the use of an element in concert with the grinding tool and the processing of signals generated by the element in scanning the edge of the glass pane. More particularly, the element is disposed for movement in the direction toward the rotational axis of a plate, supporting the glass pane for movement, and displaced by an angle ($\alpha,\beta$) in relation to the grinding tool. The path control program for the grinding tool will be determined by values as may have been stored in a sliding register and, then, found at the output of the sliding register after a timed interval corresponding to the rotational angle ($\alpha,\beta$) between the point of contact of the element and the point of contact of the grinding tool along the edge of the glass pane. The output value is used to control the position of the grinding tool relative to the axis of rotation of the glass pane.

Contrary to the prior art, represented by the publication, the process of the invention is in the positioning of the grinding tool for each individual glass pane by a determination, individually, by scanning the contour of the edge of the glass pane that is to be processed. Information from the scanning process, at least for a partial extent of the periphery of the edge of the glass pane, relating to path or position, is fed to a storage from which it is taken after a period of time corresponding to the time taken for rotation of the glass pane through the rotational angle of displacement of the element for scanning and the grinding tool. To this end, the storage will contain, temporarily, a control signal corresponding to the length of the extent of that periphery.

According to the invention, not only is it possible to process glass panes having substantially any shape without resort to special measures for aligning the glass panes, for example, it is also possible to process glass panes of different shape as they are moved seriatim to the all-around edge processing apparatus. Thus, the application of the grinding machine may be increased considerably. Further, the process may be conducted more economically since readjusting times in the readjustment from one program of path control to another are omitted.

While the process has been generally described in relation to the practice of the process in the control of tools of an all-around edge grinding apparatus, the process may be used in the same manner in the control of tools in other apparatus by which glass panes may be processed either along their edge or on a surface parallel to the edge of the glass pane. With regard to the latter capability, it oftentimes is the case that a glass pane is provided along the edges of the glass pane or along the edge area of the surface of the glass pane with a strip which may be an electrically conductive strip or a decorating strip. The path control process according to the invention may be utilized in this operation, also. A further capability of the process may be that of incorporation of a control in a program of measurement of the contour of the glass pane. In this manner, for example, the invention may be used for control of the shape of the glass pane by comparing the values determined by the control arrangement with stored theoretical values.

Many alternatives may be resorted to in the overall construction of the apparatus for carrying out the process. For example, according to a first form of the invention the grinding tool and a scanning element may be disposed for movement linearly along an axis that is colinear with a radius from the rotational axis of the plate which mounts the glass pane for movement. The grinding tool and the scanning element are displaced by an angle $\alpha$ described by the radii as discussed. The grinding tool and the scanning element are disposed on a sled, each of which is movable relative to an electric path recorder. The grinding tool may be provided with an adjustment motor drive and the control may include a sliding register storage and a regulating amplifier controlled by the path recorder which shall cooperate with the sled carrying the scanning element. A control signal from the sliding register storage, delayed for a period of time corresponding to the period of time required for rotation of the plate through the angle $\alpha$, controls the position of the grinding tool.

According to another form of the invention, the grinding tool is disposed on a first rocker arm, and the scanning element is disposed on a second rocker arm. Both the grinding tool and the scanning element are capable of movement in a circular path about the axis of rotation of each rocker arm, and the rocker arms, in relation to the rotational axis of the plate, are displaced by an angle $\beta$. The first rocker arm is provided with a collating rotor which provides a signal determination of the angular position of that rocker arm. The control for controlling the position of the grinding tool comprises an angle producer, a sliding register storage for temporarily delaying a control signal to the collating motor of the first rocker arm carrying the grinding tool and a regulating amplifier which shall directly control the second rocker arm with the control signal after the delay. The delay corresponds to the time taken for rotation of the glass pane through the rotational angle $\beta$.

A torque motor acts upon the scanning element so that the scanning element scans the edge of the glass pane under conditions of constant pressure. In the first form of the invention, the torque motor acts upon a sled which mounts the scanning element for linear movement, and in the second form of the invention, the torque motor acts about the rotational axis of the rocker arm which mounts the scanning element. The torque motor, also, provides for the movement of the scanning element between its operating and rests positions.

The grinding tool effectively should be pressed against the edge of the glass pane under conditions of a continuous or regulating force. In certain cases, preferably during rotation of the glass pane and movement of the scanning element as it scans a sharply acute corner, the torque motor may assist in changing or correcting the force of pressure of the grinding tool. The change or correction of the grinding tool may be programmed, also.

A speedometer machine may be mechanically connected with the drive shaft of a motor for adjusting the position of the scanning tool. The speedometer machine develops a signal which together with signals from a path recorder, processed by an evaluation unit, provide a start signal. The start signal functions to regulate the speed of the drive to the plate and the glass pane which it supports. Thus, the start signal represents a measurement of the speed of a position change, for example, whenever a sharply acute corner of the glass pane moves past the scanning element and grinding tool.

The discussion above which briefly develops the features and advantages of the invention in both the process and apparatus which distinguish it from the prior art will be greatly expanded upon as the description continues, and as the description is considered with the drawing.

BEST MODE FOR CARRYING OUT THE INVENTION

Figure 1:
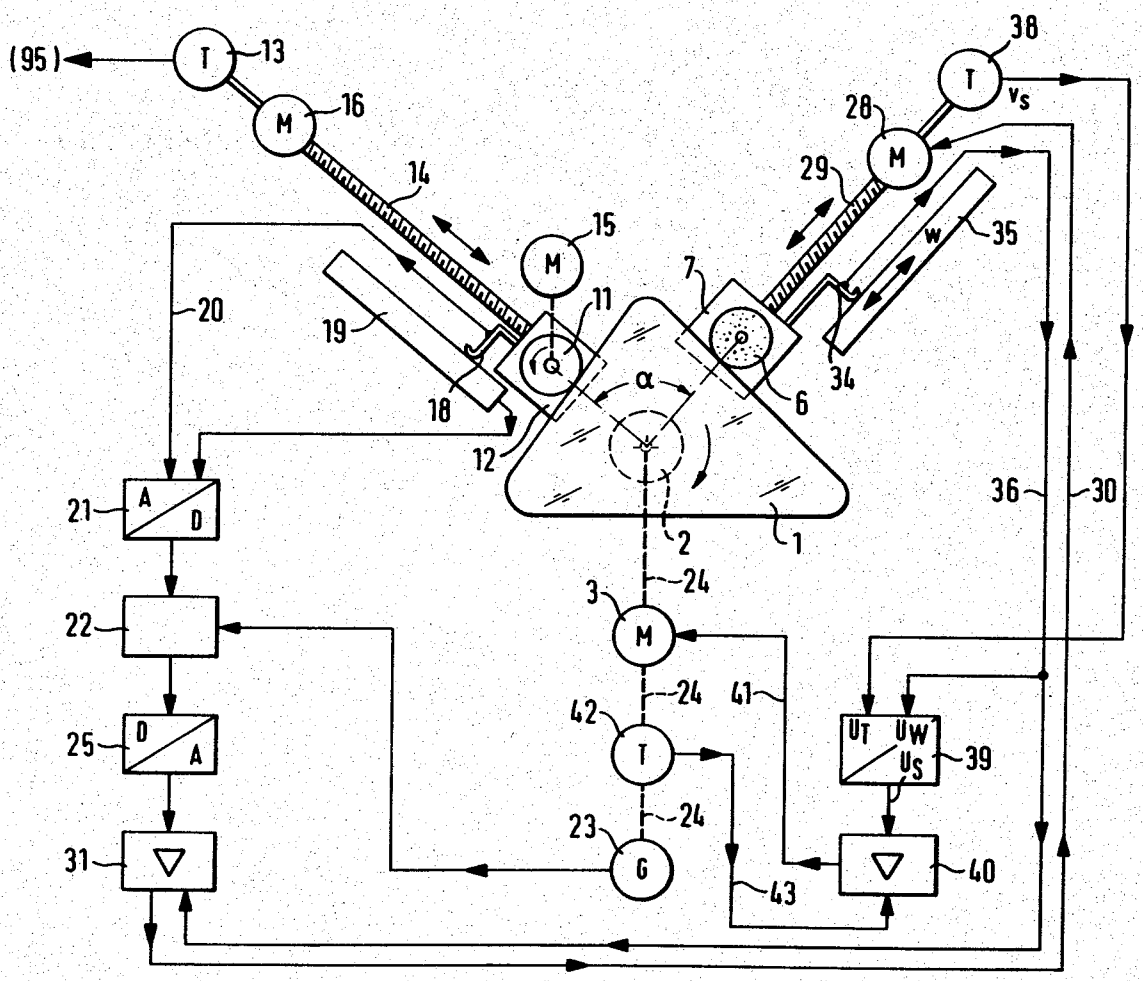
FIG. 1 is a schematic illustration of one form of grinding machine of the invention.

With reference to FIG. 1, there is illustrated a glass pane 1 which is to be ground along its edges, completely around the perimeter of the glass pane. The glass pane may take any form, such as that of the three-sided glass pane of the Figure. A plate 2 provides a support for the glass pane. The plate may be of the type having capability of developing a suction force within the confines of a rim, and the plate mechanically supports the glass pane within the region of its center of gravity for movement about an axis of rotation. To this end, a motor 3 is connected to the plate and drives the plate rotationally at a slow, constant speed during the grinding process. A drive shaft 24 illustrated by the dotted lines in FIG. 1 serves to drivingly connect the plate and motor.

A sled 7 is mounted for movement relative to the axis of rotation of plate 2 and glass pane 1. Particularly, and with regard to FIG. 2, it will be noted that the sled is mounted on a pair of rails 8 supported in spaced, parallel relation below the plane of the glass pane. The rails are mounted in a fixed orientation (by frame structure, not shown) relative to the glass pane and the sled 7 is adapted for movement back and forth, along the rails longitudinally in a direction radially inward and outward of the axis of rotation. A grinding tool 6 is carried by the sled for movement with the sled. The grinding tool is mounted for rotation, for example, in the counterclockwise direction in FIG. 1, by structure to be described.

A second sled 12 is also mounted relative to the axis of rotation of plate 2 and glass pane 1. The manner of mounting sled 12 may duplicate the manner of mounting of sled 7 whereby sled 12 may move back and forth, along a similar path. A scanning roller 11 is carried by sled 12.

Sled 12 and sled 7, more particularly the axes of their longitudinal movement path relative to the axis of rotation of plate 2 are displaced by an angle $\alpha$ in the direction opposite to the direction of rotation of the glass pane (see the arrow in FIG. 1).

A spindle 14 supports sled 12. A motor 16 is mechanically coupled to the spindle. A driving input to the motor drives the spindle in one direction or the other. Drive of the motor is followed by rotation of spindle 14, thereby to drive sled 12 in the manner heretofore discussed. At the commencement of a grinding process, the sled 12 and scanning roller 11 will be located to the position illustrated in FIG. 1 and at the end of the grinding process the sled and scanning roller will be located to a position of rest radially removed from the operative position.

The motor 16 may be a torque motor and functions in a manner so that the scanning roller 11, during a grinding process, is always pressed against the edge of glass pane 1. The torque motor, further, maintains a constant pressure between the scanning roller and the glass pane. A speedometer machine 13 is coupled either with spindle 14 or motor 16 and measures the speed of change of position of the scanning roller relative to the glass pane. The speedometer machine will be described in greater detail as the description continues. For the moment, however, it is to be noted that the speedometer machine provides a signal output in response to the measurement of change of position which output is used in regulating the contact pressure developed between grinding tool 6 and the edge of glass pane 1 to be ground. The signal output is also fed to a measuring trigger 95, see FIGS. 1 and 3.

A motor 15 provides a driving input to scanning roller 11 to rotate the scanning roller for purposes of substantial reduction of friction losses. The mechanical coupling of the motor and the scanning roller is illustrated by the dash line in FIG. 1.

A path recorder 18 provides a signal output representative of the position of sled 12 and consequently the scanning roller 11 relative to the axis of rotation of plate 2. The path recorder is in the form of an electrically conductive finger biased into contact with a sliding resistance 19. The sliding resistance is connected at one end in series with an analog/digital converter 21. Movement of the finger or tap along the sliding resistance in response to the positioning of sled 12 serves to tap a voltage at a level which represents a linear position of orientation of the sled relative to the axis of rotation of plate 2. The voltage level which also represents the position of the scanning roller in relation to the same reference is connected to the analog/digital converter. The connection is a series connection along line 20. The output of the analog/digital converter is a digital value representing the voltage at the tap. The output is connected to a sliding register 22.

The sliding register 22 may comprise a component of a microcomputer. A timing pulse generator 23 is connected to the sliding register and times the sliding register in accordance with the speed of rotation of plate 2. To this end, the timing pulse generator is coupled mechanically to drive shaft 24, and electrically coupled to the sliding register 22.

A digital/analog converter 25 is connected at the output of the timing pulse generator 23. In a manner to be discussed, the output signal of the digital/analog converter, in the form of a timed voltage level, is used to provide position control of the grinding tool 6.

Sliding register 22 is of a construction such that the output signal comprising a theoretical value voltage for position control of the grinding tool 6 is delayed by a time interval equal to the length of time required for rotation of plate 2 through the angle $\alpha$. As indicated, the plate 2 is rotated at a constant speed and the angle of rotation which is of concern is enclosed by the dot-dash radial lines (see FIG. 2) extending colinearly with the axes of movement of sleds 7, 12. When the plate shall have rotated through the angle $\alpha$, the grinding tool 6 will be located at the position along the edge of the glass pane relative to the axis of rotation of plate 2, to which the scanning roller previously was located.

A spindle 29 supports sled 7. A motor 28 is mechanically coupled to the spindle to rotate the spindle in one direction or the other thereby to adjust the position of the sled, and consequently the grinding tool 6, relative to the axis of rotation of plate 2. The motor may be an adjusting motor, triggered into operation by the timed voltage output of digital/analog converter 25, as regulated by regulating amplifier 31. The connection is by line 30.

A path recorder 34 like the path recorder 18 provides an electrical voltage representative of the position of sled 7 and consequently the grinding roller relative to the axis of rotation of plate 2. The path recorder provides a tap movable along a sliding resistance 35 in the form of a grinding contact. The electric voltage which is tapped, comprising an actual value serving as an acknowledgement of the grinding tool position is connected to the regulating amplifier 31. The connection of path recorder 34 to regulating amplifier 31 is completed by line 36.

The path recorder 34 provides a second function. To this end, and in concert with operation of a speedometer machine 38, the path recorder controls the speed of drive (revolutions per minute) of plate 2 as may be required if there is a recognized change in the position of sled 7 relative to the axis of rotation of plate 2. In this manner, and as discussed below, the effective grinding speed may be maintained constant.

If there should be a change in the position of the grinding tool 6 toward the edge of the glass pane 1, or in the opposite direction, there will result an undesirable increase or decrease of the grinding effect. Accordingly, it is necessary to compensate for these undesirable influences. To this end, it is possible to change the speed of rotation of plate 2 as a factor of the position of sled 7, and consequently the grinding tool, as well as the rate of change of the position of the sled relative to the axis of rotation of the plate. Particularly, a series of voltages generated by the path recorder 34 and speedometer machine 38, the latter of which is coupled either with the spindle 29 or motor 28, are connected to an electronic unit 39. The voltages include the voltage output of path control 34, also connected with the regulating amplifier 31, and the voltages $U_t$ and $U_w$ generated by speedometer machine 38. The electronic unit processes the several inputs to provide a starting voltage $U_s$. This voltage which is a theoretical value voltage provides an input to the regulating amplifier 40. A speedometer machine 42 is mechanically coupled to drive shaft 24. The speedometer machine provides a starting voltage which is an actual value representing the speed of the drive shaft. The actual voltage is connected on line 43 to the regulating amplifier 40. The output of regulating amplifier 40 is connected over line 41 and provides a control for motor 3, and, thus, the speed of rotation of plate 2.

Figure 2:
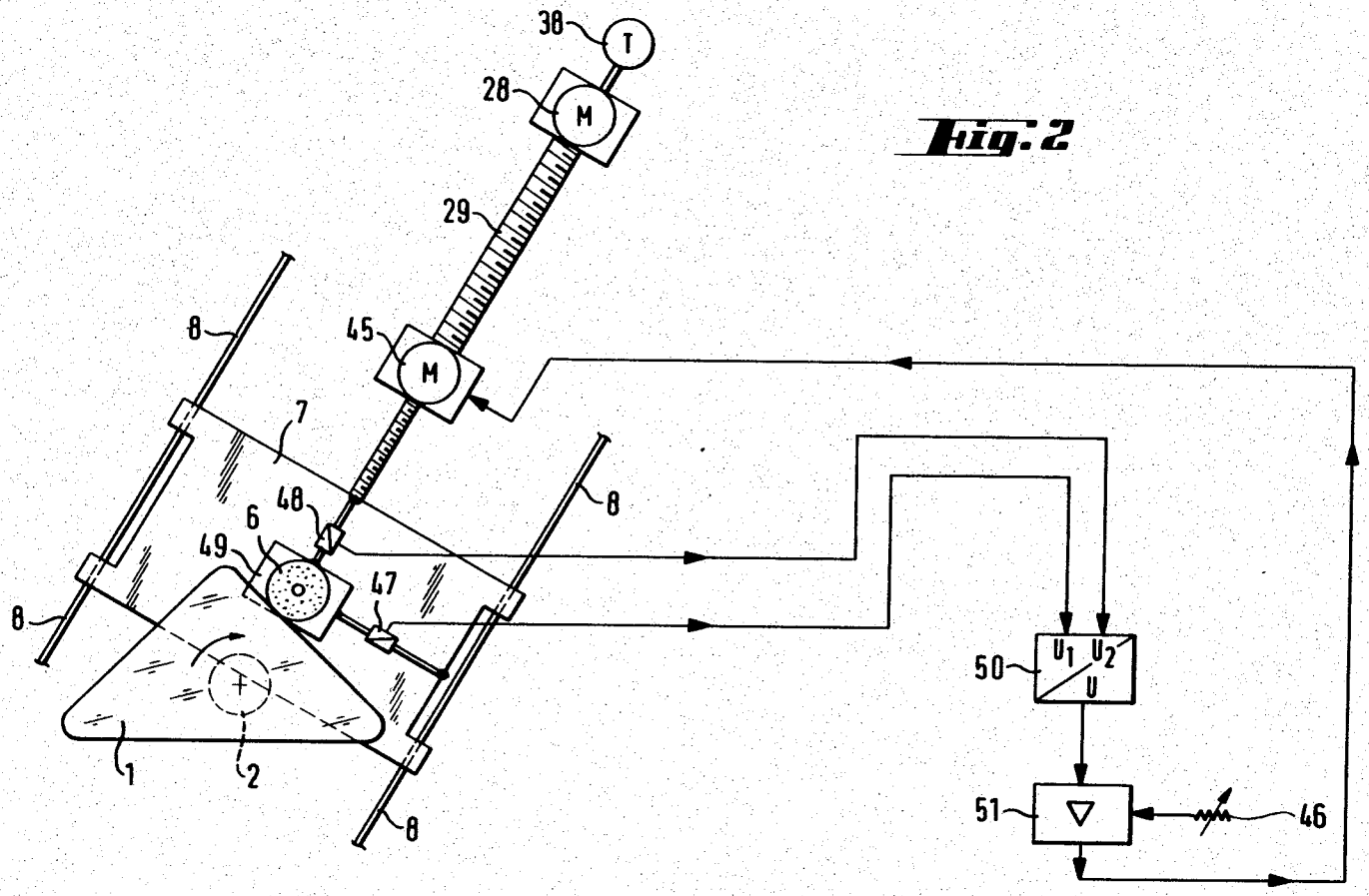
FIG. 2 illustrates a grinding aggregate including a torque motor for regulation of grinding pressure for the apparatus of FIG. 1.

Referring now to FIG. 2, a torque motor 45 may be provided either for maintaining a specific grinding force between the grinding tool 6 and the edge of glass pane 1 which is to be ground or regulating the grinding force in accordance with a predetermined program. The torque motor may be mechanically coupled between the adjusting motor 28 and sled 7. A potentiometer 46 is provided in the system for adjustment of the desired theoretical value for maintaining the specific grinding force.

A pair of pressure components comprising load cells 47, 48 measure the grinding pressure exerted between the grinding tool 6 and the drive motor for the grinding disc. The load cells are mounted on a plate 49. The plate, in turn, is connected mechanically to sled 7 by the load cells 47, 48. The power component measured by load cell 47 results from the pertinent spatial position of the edge of the glass pane relative to the grinding disc. This power component may be a positive or a negative value and may change constantly as the spatial position of the component changes. The effective grinding pressure to be exerted on the edge of the glass pane will correspond to the geometrical sum of two power components. The values from each of the load cells 47, 48 converted by the load cells themselves into electrical voltage values, are connected to computer 50. The values comprising the value $U_1$ representing the power component from load cell 47 and the value $U_2$, representing the power component from load cell 48, are geometrically summed by the computer, and a voltage $U_a$ (actual value) at the output of the computer provides a regulating voltage for regulating the torque motor 45. The voltage $U_a$ is an actual value of the automatic control system and together with a theoretical value voltage, adjusted by potentiometer 46, provides the input to a regulating amplifier 51. The output of regulating amplifier 51 triggers the torque motor 45.

Regulation of the grinding pressure may also be carried out by following a program which functions to lower the grinding force exerted by the grinding disc of the grinding tool at each corner of glass pane 1, and to increase the grinding force once the region of the corner has been processed following rotation of the glass pane relative to the grinding tool. Generally, this operation requires several potentiometers in place of the potentiometer 46, with the potentiometers being switched into and out of a circuit to a control voltage in some succession of operation corresponding to the program. A system of an all-around grinding program for regulating the grinding pressure may be seen in FIG. 3.

Figure 3:
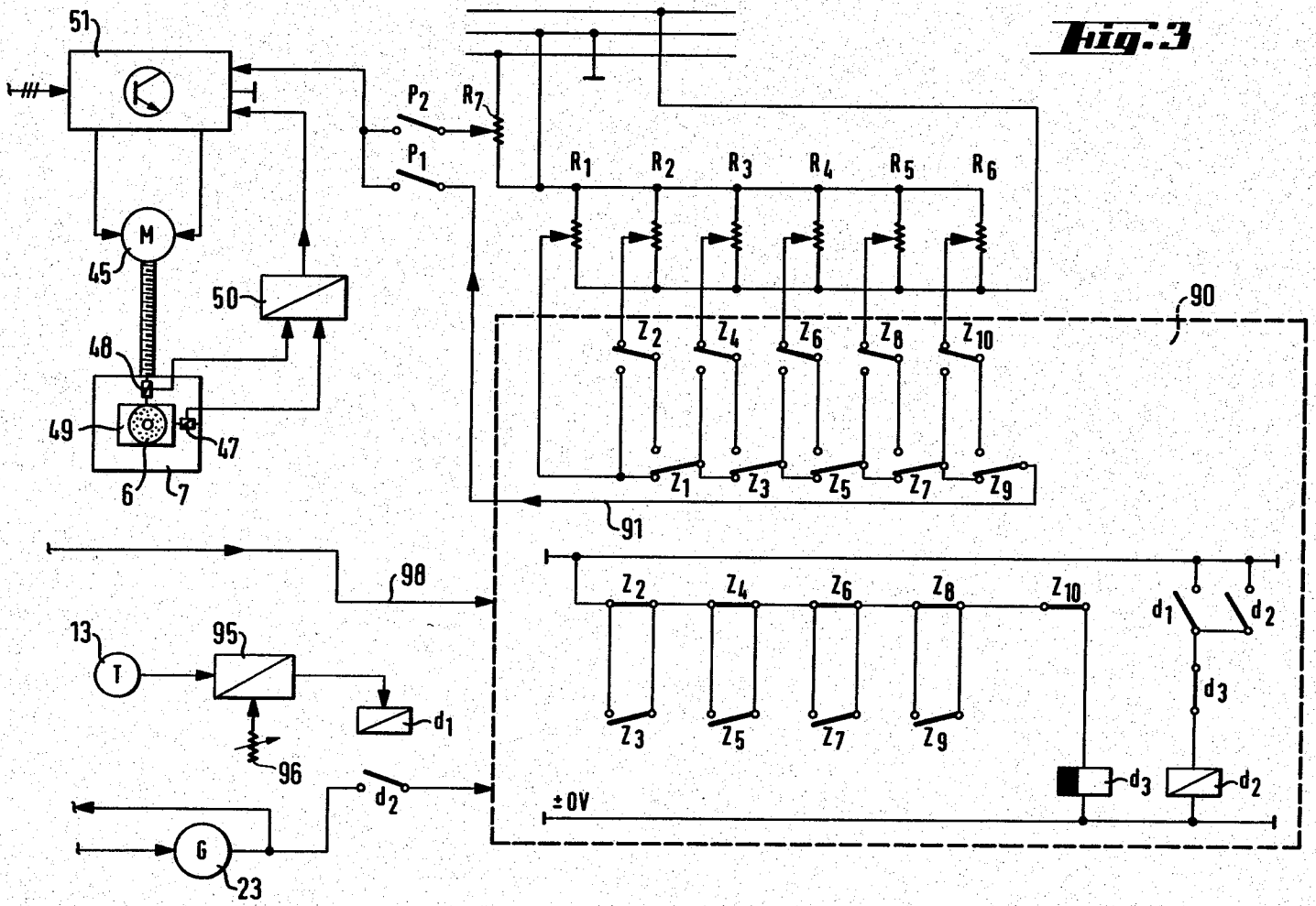
FIG. 3 is a circuit diagram of a programmer for the torque motor for regulation of grinding pressure.

The system for control of an all-around grinding program of FIG. 3 is a system capable of use with a multi-edged glass pane. Particularly, the system comprises a counter 90 of preselection-digital type, illustrated as enclosed within the dash line. Any commercial counter having ten capabilities of preselection may be used. The counter will have a function capability to change the grinding pressure at a maximum of five corners and, then, to set the standard pressure once the corner has rotated relative to the grinding tool. The change in grinding pressure will be that of a decrease at a corner and an increase to that of the standard pressure.

Potentiometer R1 functions to adjust a preselected theoretical value of pressure, while the value of guiding pressure, through some decrease for individual corners, is adjusted by adjustment of potentiometers R2–R6. Thus, potentiometer R2 may be adjusted to adjust the grinding pressure at a first corner, while the successive potentiometers adjust the grinding pressure at the next and following corners.

A control voltage may be sensed on line 91 and connected through contact P1 to the regulating amplifier 51. Potentiometer R7 serves the purpose of raising the grinding pressure at the completion of the grinding process and to pull back the grinding tool to the position at which the grinding process may commence. The control voltage, adjusted by adjustment of potentiometer R7, is connected through contact P2 to the regulating amplifier, also.

Speedometer machine 13 provides a control signal for changing, that is, decreasing the grinding pressure at each of the several corners of the glass pane. Whenever the scanning roller 11 scans a corner of the glass pane, the scanning action is expressed in a voltage value and a change in polarity of the voltage. The signal representing the change in voltage value and that of the reversal of polarity of the voltage provides a control signal for triggering the counter 90.

The grinding pressure normally will require change when sensing an acute angled corner as the corner moves relative to the grinding tool. The signal from speedometer machine 13 is connected to a measuring trigger 95. A potentiometer 96 may be adjusted to control or fix the desired switching point, representing the first corner having the acute character requiring a change of the grinding pressure. Thereafter, speedometer machine 38 will signal a corner. Measuring trigger 95 will respond to the corner signal and the relay d1 will energize to close the relay switch d1 and a ganged relay switch d2 thereby to energize relay d2. Relay d2 is a holding relay and connects the counter 90, then at a zero level, with the timing pulse generator 23. It will be recalled that the timing pulse generator is mechanically coupled to drive shaft 24. As illustrated in FIG. 1, the timing pulse generator is connected to the sliding register to provide timing in accordance with the speed of rotation of the drive shaft. The counter 90 is programmed in a manner that after a turn of the glass pane 1 through the angle $\alpha$, meter relay Z1 will respond. Whereas, heretofore, potentiometer R1 functioned to adjust the standard pressure or preset the theoretical value, a response of meter relay Z1 will switch potentiometer R2 into the circuit and switch potentiometer R1 out of the circuit. Thus, potentiometer R2 will be used to preset the theoretical value. The potentiometer R2 will remain on as a result of that preselection and will remain for a period determined by the rotary angle of plate 2. When meter relay Z2 shall be triggered the potentiometer R1, again, will be connected to the control voltage and the circuit to potentiometer R2 will open. At the instant of triggering the meter relay Z2 the circuit to circuit breaker wiper d3 will open. As a result of the open circuit, relay switch d3 opens to deenergize relay d2. The counter timing, then, is interrupted and the counter 90 is stopped. This condition remains until the speedometer machine 13 responds to the second corner having the acute character which shall require a change in the grinding pressure.

When there shall be a response from speedometer machine 13, the relay d1 is energized to again energize relay d2 and the process which has been described is repeated. The process is repeated, however, through operation of meter or preselection relays Z3 and Z4. These preselection relays and their operation result in the simultaneous switching of potentiometers R1 and R3 into and out of the control voltage circuit. In this manner one potentiometer or the other will be operative in a control sense. When potentiometer R3 is switched out of the circuit the circuit to relay d3 opens. The process is repeated through response of speedometer machine 13 to the remaining corners having the critical acute character. In these responses the preselection relays Z5 and Z6, . . . Z9 and Z10, if there shall be five corners, will operate.

A glass pane having a number of corners, up to five corners with each corner having an acute characteristic requiring a change in grinding pressure, may be ground following the described process. And, each corner may be ground by application of a different grinding pressure by adjustment of the potentiometers R2–R6. At the completion of the all-around grinding process, an eraser entry over line 98 sets the counter 90 to zero.

The operation is as follows: a scanning roller 11 and grinding tool 6 together with their supporting sleds 12 and 7, respectively, are located to a retracted, rest position. A glass pane 1, either automatically or manually, is positioned on plate 2 and the plate is connected to a source of vacuum for purposes of securement of the glass pane for rotation. When the glass pane is secured it is driven in rotation, the speed of which is determined by a motor 3 under control of a path recorder 34 according to the positional relationship of the grinding tool 6 in the rest position. The current for motor 16 is switched on thereby to locate the sled adjacent the glass pane and in a position that the scanning roller rests against the edge of the glass pane. The motor 16 functions as a torque motor to adjust the pressure of the scanning roller against the edge of the glass pane. At this point, that is, when the scanning roller is in the scanning position, the electronic system commences the grinding operation. The sled 7 and sled 12 are displaced in a phase-shifted manner through a rotary angle $\alpha$. The regulating arrangement including the manner of regulation of grinding pressure is as illustrated in FIG. 3 and discussed above.

Figure 4:
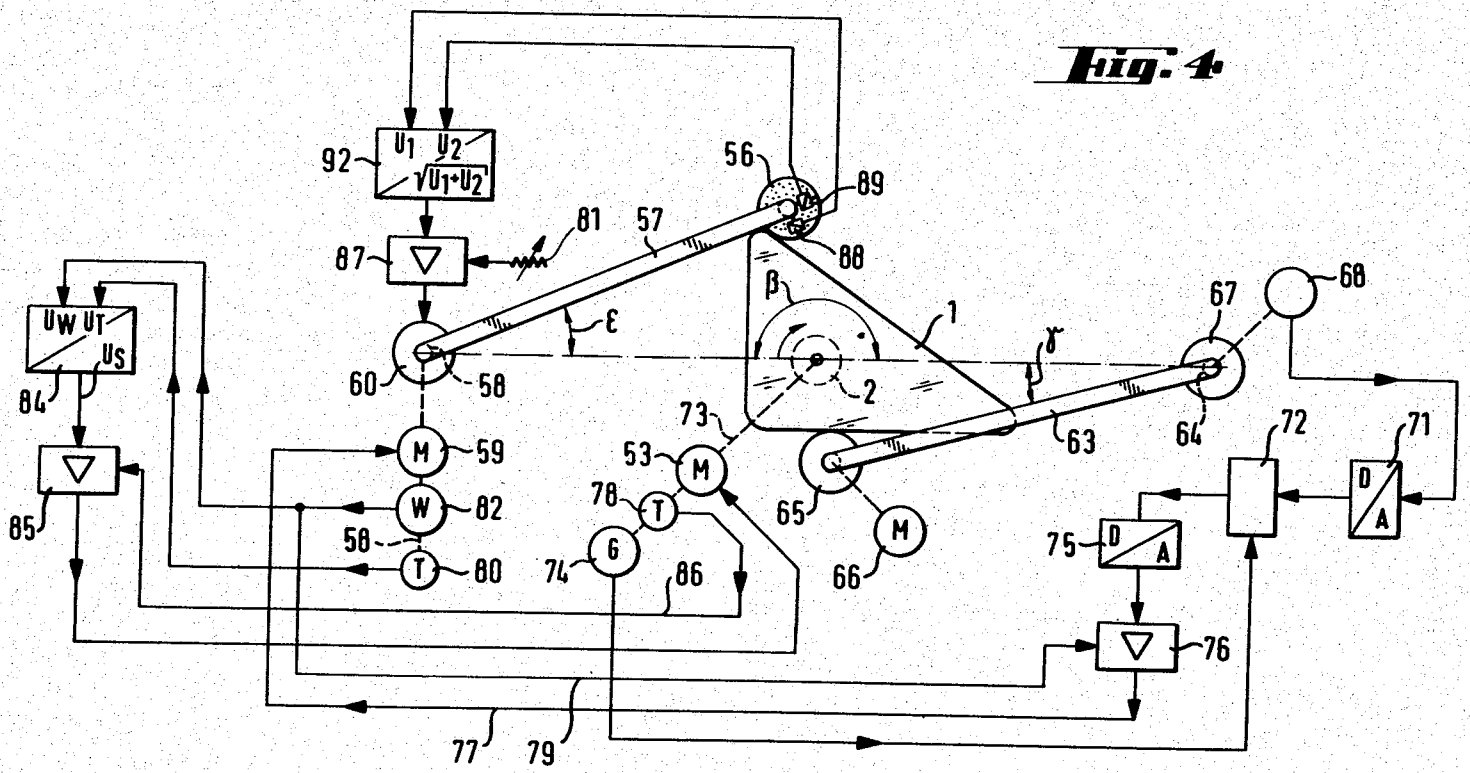
FIG. 4 is a schematic illustration of a second form of grinding machine of the invention.

A second form of the apparatus of the invention may be seen in FIG. 4. This form differs from the form illustrated schematically in FIG. 1 principally in the manner of mounting the grinding tool and the scanning roller. Whereas, referring to the FIG. 1 form, the grinding tool 6 was mounted on sled 7 and scanning roller 11 was mounted on sled 12, with both of the sleds being movable linearly along a longitudinal axis arranged colinearly with a radius extending from of the axis rotation of plate 2, in the form of the invention now to be described the grinding tool and scanning roller are mounted on respective rocker arms.

Referring to FIG. 4, a glass pane 1 is mounted on plate 2 for movement about the rotational axis of the plate. The positional relationship of the glass pane and the construction of the plate are as discussed, above. A driving motor 53 is connected to the rotational axis by drive shaft 73 to drive the plate at a constant speed. As indicated, a grinding tool 56 and scanning roller 65 are mounted by rocker arms 57 and 63, respectively.

Turning to the grinding tool 56, the grinding tool or disc is disposed at one end of rocker arm 57. The other end of the rocker arm is mounted on an axis 58 so that the grinding tool may be moved or guided in a circular path about the axis 58. A motor 59 comprises a collating or adjusting motor. The motor is mechanically coupled to the axis 58 and a drive to the motor determines the angular position $\epsilon$ of the rocker arm 57 relative to a reference line connecting the axis 58, the axis of rotation of plate 2 and an axis 64, the latter of which defines the center of a circular path within which the scanning roller 65 may be moved. The adjusting motor will also determine the angular position of the grinding tool or disc which moves with the rocker arm 57.

A torque motor 60 is located concentrically about the axis 58. The torque motor may function in response and according to a program, and provides regulation of the grinding pressure exerted by the grinding tool or disc on the edge of glass pane 1. The regulating function of torque motor 60 is independent of the angular position of rocker arm 57 so that the grinding pressure remains constant as the glass pane rotates. Regulation of the grinding pressure may also follow the manner of control illustrated in FIG. 3.

The rocker arm 63 mounts the scanning roller in similar fashion and is similarly mounted to guide or move the scanning roller in a circular path about the axis 64. The axis 64 is displaced from the axis 58 by an angle $\beta$ in the direction of rotation of plate 2. The disposition of axis 64 as illustrated in FIG. 3, located along the reference line, is displaced at an angle of 180°.

The rocker arms 57 and 63 are coextensive in length. A motor 66 is mechanically connected to the scanning roller for driving the scanning roller to reduce or substantially eliminate any friction loses as the scanning roller tracks the edge of the glass pane. A torque motor 67 is arranged coaxially along axis 64 to assure that the scanning roller exerts a constant force on the edge of the glass pane. The torque motor, also, functions to return rocker arm 63 to a rest position after the scanning process or prior to the commencement a grinding process. At this time the glass pane 1 will have been disposed on plate 2 and secured by a vacuum force, and the scanning roller 65 will have been moved to the edge of the glass pane.

An angle generator 68 which is mechanically coupled to the axis 64 determines the angle or swivel angle $\gamma$ of rocker arm 63 and scanning roller 65 relative to the aforementioned reference line. The angle generator functions to deliver a DC voltage signal corresponding to the angle $\gamma$. The signal is converted by an analog/digital converter 71 to a corresponding digital value, and the digitized signal is connected to a sliding register 72. A timer 74 mechanically coupled to drive shaft 73 for driving plate 2 times the sliding register. Particularly, the timer is designed in a manner that the digitized signal connected to the sliding register appears at the output of the sliding register when the plate 2 and the rotary value of movement indicates rotation through the angle $\beta$. In the form of FIG. 4, the rotation will be through an angle of 180°.

The sliding register 72 may comprise a part of a microcomputer and the signal output, delayed by the timer 74, provides an input to the digital/analog converter 75. The analog voltage value at one input of regulating amplifier 76, therefore, is a theoretical value voltage used to control or adjust the adjusting motor 59. The control is over line 77. An angle generator 82 mechanically coupled to the axis 58 of rocker arm 57 develops an actual value of the angular position $\epsilon$ of the rocker arm 57. The actual value signal of the angle generator provides a second input to the regulating amplifier 76. This control is over line 79.

To compensate for any influence exerted by the spatial position of the processed part of the edge of the glass pane, at any time, on the effective grinding speed, it is necessary to control the speed of rotation of drive shaft 73 and plate 2. To this end, it is necessary to regulate motor 53, which regulation will be a function of the angular position of rocker arm 57 and the speed at which the rocker arm may swivel about the axis 58.

In the regulation of motor 53, a voltage $U_w$ which is the output of angle generator 82 and a voltage $U_t$ which is the output of the speedometer machine 80, both of which are mechanically coupled to the axis 58 of the rocker arm 57, are processed by an electronic unit 84 which provides a starting voltage $U_s$. The starting voltage is a theoretical value voltage representing the speed of the motor 53 which provides an input to regulating amplifier 85. An actual value voltage representing an actual speed of rotation sensed by speedometer machine 78 is connected to another input of the regulating amplifier. The output of the regulating amplifier, in turn, is connected to motor 53.

The form of the invention of FIG. 4 permits regulation of the effective grinding pressure. The regulation control is a function of the value of the spatial position of the edge of the glass pane to a constant value or to a predetermined programmed value. To this end, a potentiometer 81 is adjusted to the theoretical value of the grinding pressure, or the regulation control may follow the scheme discussed in relation to FIG. 3, to provide an input to a regulating amplifier 87. The regulating amplifier provides control for the torque motor 60.

Further, the grinding tool 56 may be mounted by a pair of load cells 88, 89 to the rocker arm. In a manner as heretofore discussed, the load cells are connected to a computer 92. The input $U_1$ and $U_2$ from the respective load cells representing the power components of the effective grinding pressure as positive or negative electric voltages are geometrically summed by the computer. The output comprises an actual value of the regulating circuit and is the input at the other input terminal of the amplifier.

We claim:

1. A process for the path and position control for processing seriatim the edge of a glass pane of substantially any contour which may be the same of different shape from preceding and following glass panes as the glass pane undergoing processing rotates on a rotating plate relative to the processing tool, said processing tool being adapted for shiftable adjustment in a direction toward and away from a rotational axis of the plate as a consequence of the edge contour of the glass pane that is to be processed, and wherein the process is characterized by providing an element, adapted to shift in the direction toward and away from said rotational axis, for scanning said edge contour, locating said scanning element in a direction opposite to the direction of movement of said glass pane and at an angular displacement ($\alpha$ $\beta$) in relation to the processing tool thereby to sense each increment of the edge contour of the glass pane before that increment rotates to the processing tool for determining a path control program for the processing tool, storing signal values representing shifts in the position of said scanning element relative to said rotational axis in a register whose output controls a motor which operatively adjusts the position of said processing tool and delaying said output for a time interval corresponding to an angle of rotation ($\alpha$ $\beta$) between points of contact of the processing tool and scanning element along the contour, such that the tool will follow exactly the edge contour of the glass pane dictated by the scanning element.

2. Apparatus for the path and position control of a tool for processing seriatim the edge of each of a plurality of glass panes of substantially any contour, and each glass pane undergoing processing having a contour which may be different from preceding and following glass panes, comprising a plate for supporting said glass pane undergoing processing, said plate adapted for movement about an axis of rotation thereby to prevent successive increments of the edge of said glass pane to a processing tool adjacent said edge, and adapted for shiftable adjustment in a direction toward and away from said axis of rotation as a consequence of the edge contour of the glass pane being processed, an element contacting said edge for scanning said contour, means mounting individually said processing tool and scanning element for movement along longitudinal axes, each of which are located colinearly with a radius extending from the axis of rotation, said mounting means disposed relative to said plate so that said scanning element is located at an angular displacement upstream of said processing tool as determined by the direction of rotation of said glass pane, a motor for shiftably adjusting said processing tool in said, directions and an electric control system for controlling said motor, said system including means providing a signal response representative of movement of said scanning element as it follows said contour, and a register for storing said signal response, said register being controlled to delay an output to said motor for a period of time corresponding to the time required for rotational movement of said glass pane through said angular displacement, so that the processing tool will follow exactly the edge contour of the glass pane dictated by the scanning element.

3. The apparatus of claim 2 wherein said signal response means is a digital signal producer.

4. The apparatus of claim 2 wherein said signal response means is an analog signal producer, and wherein said electric control system includes an analog/digital converter connected between said register and signal producer whose signal is an electric voltage having a voltage level which electrically represents a spatial disposition of said scanning element relative to said axis of rotation.

5. The apparatus of claim 2 wherein said means mounting said processing tool comprises a sled, a path recorder carried by said sled providing an actual value signal of the position of said processing tool relative to said axis of rotation; and wherein said electric control system further includes a regulating amplifier, said regulating amplifier including a pair of input terminals and an output terminal, said output terminal connected to said motor and providing an output controlled by an input from each of said path recorder and register.

6. The apparatus of claim 2 wherein said means mounting said scanning element comprises a sled, and wherein the apparatus further includes a torque motor for acting an said sled thereby to maintain a constant contact pressure between said scanning element and the edge of said glass pane.

7. The apparatus of claim 2 wherein said means mounting said processing tool comprises a sled, and wherein said apparatus further includes a torque motor for regulating the contact pressure of the processing tool against the edge of the glass pane, said torque motor being interposed between said adjusting motor and sled.

8. The apparatus of claim 7 further including at least one load cell for responding to an actual value of contact pressure exerted by said processing tool on the edge of said glass pane, a carrier for mounting said processing tool, said at least one load cell mounting said carrier on said sled, and wherein a signal representative of said actual value of contact pressure provides a trigger signal for control of said torque motor.

9. The apparatus of claim 2 further including a speedometer machine responsive to the output of said adjusting motor, and wherein said electric control system further includes an evaluation unit, a regulating amplifier connected at the output of said evaluation unit for control of a rotary drive input for rotating said plate, and said speedometer machine output, together with the signal response representing movement of said scanning element, providing an input to said evaluation unit.

10. The apparatus of claim 2 wherein said scanning element is a roller adapted for rolling movement along the edge of said glass pane.

11. The apparatus of claim 10 further including a motor for driving said scanning roller rotationally to reduce friction of movement along said edge.

12. The apparatus of claim 2 wherein said processing tool is a grinding head for grinding the edge of said glass pane.

13. Apparatus for the path and position control of a tool for processing seriatim the edge of each of a plurality of glass panes, of substantially any contour, each said glass pane being processed having a contour which may be different from preceding and following glass panes, comprising a plate for supporting said glass pane then undergoing processing, said plate adapted for movement about an axis of rotation thereby to present successive increments of the edge of said glass pane to a processing tool, a first rocker arm mounting said processing tool at one end for movement along a circular path toward and away from said axis of rotation as a consequence of the edge contour of the glass pane being processed, a scanning element, a second rocker arm mounting said scanning element at one end for movement along a circular path, likewise, toward and away from said axis of rotation, said first rocker arm and said second rocker arm being mounted at their other ends in an angular displacement about said axis of rotation, a first motor connected to said first rocker arm for determining the angular position of said first rocker arm carrying said scanning element, a second motor connected to said second rocker arm for determining the angular position of said second rocker arm for carrying said processing tool, and an electric control system for controlling said second motor, said system including means providing a signal response representative of movement of said scanning element as it follows said contour, and a register for storing said signal response, said register being constructed to delay an output to said second motor for a period of time corresponding to the time required for rotational movement of said glass pane through said angular displacement so that the processing tool with follow exactly the edge contour of the glass pane dictated by the scanning element.

14. The apparatus of claim 13 wherein said signal response means is a digital signal producer.

15. The apparatus of claim 13 wherein said signal response means is an analog signal producer, and wherein said electric control system includes an analog/digital converter connected between said register and signal producer whose signal is an electric voltage having a voltage level which electrically represents a spatial disposition of said scanning element relative to said axis of rotation.

16. The apparatus of claim 13 further including a path recorder providing an actual value signal of the position of said processing tool relative to said axis of rotation, and wherein said electric control system further includes a regulating amplifier, said regulating amplifier including a pair of input terminals and an output terminal, said output terminal connected to said second motor and providing an output controlled by an input from each of said path recorder and register.

17. The apparatus of claim 13 wherein the apparatus further includes a torque motor for maintaining a constant contact pressure between said scanning element and the edge of said glass pane.

18. The apparatus of claim 13 wherein said apparatus further includes a torque motor for regulating the contact pressure of the processing tool against the edge of the glass pane.

19. The apparatus of claim 13 further including a speedometer machine responsive to the output of an adjusting motor, and wherein said electric control system further includes an evaluation unit, a regulating amplifier connected at the output of said evaluation unit for control of a rotary drive input for rotating said plate, and said speedometer machine output, together with the signal response representing movement of said scanning element, providing an input to said evaluation unit.

20. The apparatus of claim 13 wherein said scanning element is a roller adapted for rolling movement along the edge of said glass pane.

21. The apparatus of claim 20 further including a motor for driving said scanning roller rotationally to reduce friction of movement along said edge.

22. The apparatus of claim 13 wherein said processing tool is a grinding head for grinding the edge of said glass pane.

* * * * *

UNITED STATES PATENT AND TRADEMARK OFFICE

CERTIFICATE OF CORRECTION

PATENT NO. : 4,528,780

DATED : July 16, 1985

INVENTOR(S) : Friedrich Halberschmidt et al

It is certified that error appears in the above-identified patent and that said Letters Patent is hereby corrected as shown below:

Column 11, line 14, "The same" should be deleted

Signed and Sealed this

*Eleventh* Day of *February 1986*

[SEAL]

*Attest:*

DONALD J. QUIGG

*Attesting Officer*

*Commissioner of Patents and Trademarks*